United States Patent [19]

Lerner et al.

[11] Patent Number: 4,838,423

[45] Date of Patent: Jun. 13, 1989

[54] CONTAINER FOR THIN GLASS PLATES

[75] Inventors: Irwin S. Lerner, Orange, Conn.; Thomas J. Babbitt, York, Me.

[73] Assignee: Manufacturers Hanover Trust Company, New York, N.Y.

[21] Appl. No.: 44,207

[22] Filed: Apr. 30, 1987

[51] Int. Cl.[4] ..... B65D 85/48

[52] U.S. Cl. ..... 206/454; 206/564

[58] Field of Search ..... 206/309, 445, 449–456, 206/564

[56] References Cited

U.S. PATENT DOCUMENTS

| | | | |
|---|---|---|---|
| Re. 7,295 | 9/1876 | Osbourn | 206/449 |
| 176,341 | 4/1876 | Osbourn | 206/449 |
| 1,285,212 | 11/1918 | Kandler | 206/561 |
| 1,296,484 | 3/1919 | Cutler | 206/449 |
| 1,600,999 | 9/1926 | Sea | 206/425 |
| 1,753,663 | 4/1930 | Miller | 206/425 |
| 1,998,481 | 4/1935 | Yoder | 206/563 |
| 2,649,093 | 8/1953 | Rigney | 206/561 |
| 2,839,198 | 6/1958 | Lefevre | 206/451 |
| 2,896,821 | 7/1959 | Stegeman | 221/259 |
| 3,063,549 | 11/1962 | Weichselbaum . | |
| 3,235,068 | 2/1966 | Asnes et al. | 206/456 |
| 3,249,033 | 5/1966 | Cobb, Jr. et al. | 206/455 |
| 3,325,002 | 6/1967 | Bausch | 206/449 |
| 3,884,410 | 5/1975 | Giesecke | 206/557 |
| 4,018,643 | 4/1977 | Levine | 206/456 |

FOREIGN PATENT DOCUMENTS

| | | | |
|---|---|---|---|
| 0037552 | 5/1927 | Denmark | 206/564 |
| 2929172 | 2/1981 | Fed. Rep. of Germany | 206/449 |
| 0728823 | 12/1942 | Fed. Rep. of Germany | 206/564 |

*Primary Examiner*—Jimmy G. Foster

*Attorney, Agent, or Firm*—Marjama & Pincelli

[57] ABSTRACT

A container for thin glass plates having a base portion. The base portion is provided with a well having a substantially planar bottom surface at an angle with respect to the vertical plane of the glass slides.

21 Claims, 2 Drawing Sheets

CONTAINER FOR THIN GLASS PLATES

The present invention relates to containers for holding a plurality of individual pieces of thin glass plates.

BACKGROUND OF THE INVENTION

Thin glass plates such as microscope slides and cover glass are generally sold in packages wherein a plurality of slides are stacked either vertically or horizontally face to face in the same plane. Microscope slides typically have a length of about 75 mm, a width of about 25 mm and a thickness of about 1 mm. Cover glass typically have a length in the range of 22 to 50 mm, a width in the range of 22 to 24 mm and a thickness in the range of about 0.1 mm to about 0.2 mm. A frequent problem with thin glass plates is that adjacent pieces tend to adhere or cling together making it difficult to separate them.

This problem is particularly troublesome to very thin pieces of glass such as cover glass which are commonly used with microscope slides in laboratory research. Cover glass protects the specimen and is transparent for reviewing the specimen through a microscope. For this purpose it must be very thin and flat.

The present invention improves the ease in which individual pieces of thin glass plates may be separated and removed from the container by providing a novel container construction.

BREIF SUMMARY OF THE PRESENT INVENTION

A container for holding a plurality of individual pieces of thin glass plates comprising a base portion having a well for receiving a plurality of individual pieces. The well has a bottom surface disposed at an angle with respect to the vertical plane of the glass.

DETAILED DESCRIPTION OF THE DRAWINGS

Figure 1:
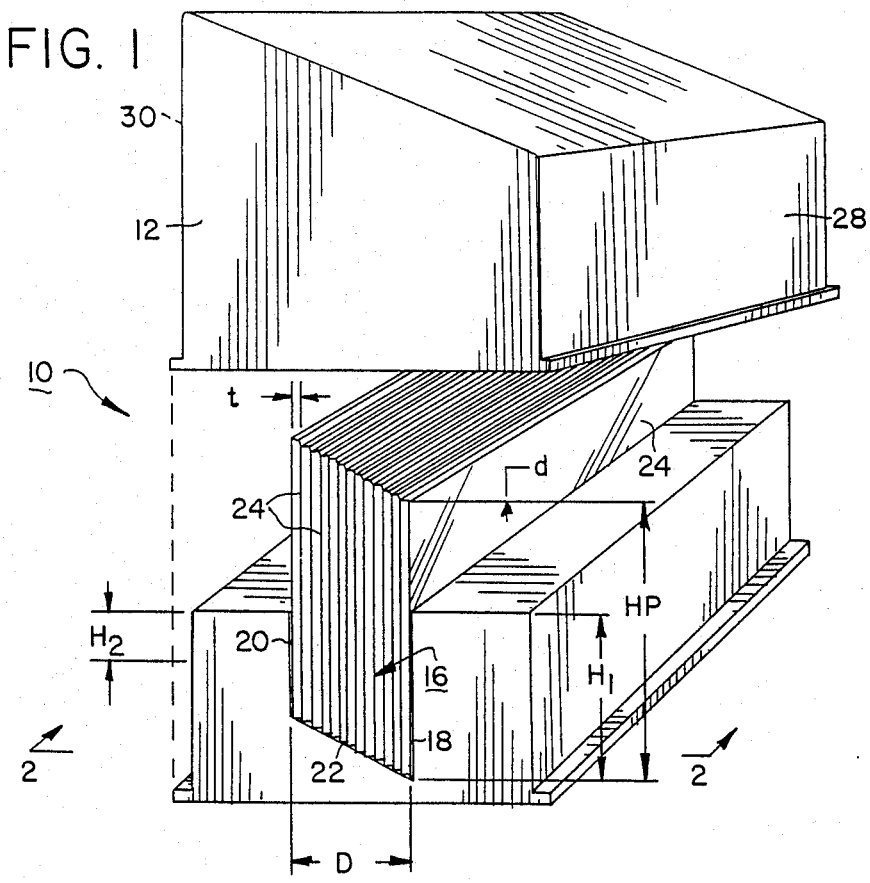
FIG. 1 is an exploded perspective view of a container made in accordance with the present invention for holding a plurality of individual pieces of cover glass.
Figure 2:
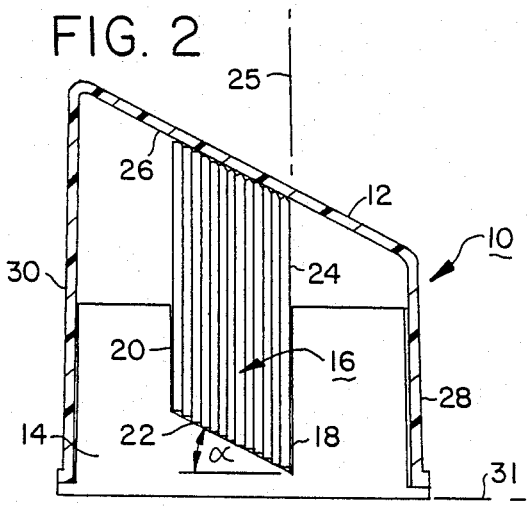
FIG. 2 is a cross sectional view taken along line 2—2 of FIG. 1 illustrating the container in the closed position, the portion is not cross-hatched for clarity.

Referring to FIGS. 1 and 2 there is illustrated a container 10 comprising a cover portion 12 and a base portion 14. In the particular embodiment illustrated cover portion 12 and base portion 14 are individually molded plstic parts. However, cover portion 12 and base portion 14 may be made out of any material, for example, cardboard or some other rigid material. Base portion 14 is provided with a recess or well 16 having a front vertical wall 18 and a rear vertical wall 20 connected by a substantially planar bottom surface 22. A plurality of individual pieces 24 of cover glass are placed in well 16 such that one side of each piece 24 lies along the bottom surface 22. In the particular embodiment illustrated well 16 does not have side portions to fully enclose the plurality of individual pieces 24 of cover glass, however, side portion may be provided if so desired. As is illustrated the long side of each piece 24 is placed on bottom surface 22. An individual piece of cover glass typically has a thickness in the range of about 0.13 mm to 0.25 mm. In the particular embodiment illustrated the thickness is about 0.15 mm. The surface area of each piece 24 may be any size and shape desired, generally being such as to adequately cover a specimen on the microscope slide upon which it is to be used. For example, an individual piece of cover glass having a substantially rectangular shape of 24 mm×50 mm in size would be used on a 25 mm×75 mm microscope slide.

The front wall 18 of well 16 has a height H1 and the back wall 20 has a shorter height H2. The height H1 and H2 are such that the individual pieces 24 of cover glass are maintained in a substantially vertical position as illustrated. The height H1 may range from about 10 per cent to 80 per cent of the height HP of pieces 24. In the particular embodiment illustrated the height H1 of front wall 18 is greater than the height H2 of back wall 20, however, if desired the height H2 of wall 20 may be greater than the height H1 of wall 18 or H1 and H2 may be the same height. The front wall 18 is spaced a distance D from back wall 20 so as to prevent an individual piece 24 from falling into the well 16 and lie flat on the bottom surface 22, preferably distance D is no greater than about 95 per cent of height HP of the individual pieces 24 of cover glass. The bottom surface 22 is disposed at an angle $\alpha$ with respect to a plane perpendicular to the vertical plane 25 of the pieces 24 such that the difference in height d between the top of adjacent cover pieces 24 allows for easy separation of furthest back piece 24 of cover glass. For the purpose of thin invention, the vertical plane 25 of the piece 24 of cover glass shall mean that plane which is parallel to the flat side of the individual pieces 24 of cover glass. This distance d will be equal to the thickness of the glass times the tangent of the angle $\alpha$. The angle $\alpha$ is selected such that each individual piece 24 extends a height d above the adjacent piece 24 so as to be easily gripped by the fingers of the user. Preferably $\alpha$ is such that the difference in height d between adjacent pieces 24 is approxmately 0.1 mm of the same order of magnitude as the thickness of the pieces 24. Applicants have found that an angle $\alpha$ in the range of about 10° to about 80° provide a sufficient height d between adjacent pieces, preferably $\alpha$ is in the range of 15° to 60°. In the particular embodiment illustrated the angle $\alpha$ is about 30°.

In accordance with the present invention a person desiring to obtain a single piece 24 of cover glass simply takes the piece 24 closest to back wall 22 and pulls it from the remaining individual pieces of cover glass. This construction has the particular advantage of rendering unnecessary the general practice of grasping multiple pieces of cover glass from the middle of the group so as to separate one therefrom. In the prior art there is a tendency of the user to mishandle cover glass by grasping more than one piece at a time, dropping the excess back into the well or slot, which may result in perspiration and moisture from fingers getting into the interface of the cover glass which can cause even further clinging together of adjacent pieces of cover glass. Additionally, the present invention minimizes the use of the thumb or finger on the interface to lift an individual piece 24 of cover glass out of the container. In the present invention, one merely needs to grasp the upper two corners of an individual piece 24 by one's fingers. Another advantage of the present invention is that as the container is emptied, each individual piece of cover glass has the tendency to fall away from the stack, making dispensing, i.e., grasping of a single piece of cover glass even easier.

In the preferred form of the invention, the cover portion 12 is designed such that the bottom surface 26 of cover 12 is inclined at an angle substantially parallel to the bottom surface of well 16. The front wall 28 and rear wall 30 of cover portion 12 are of dimensions such that the top portion 26 substantially contacts the tops of the individual pieces 24 of cover glass disposed therein. Alternately, the top portion 26 may be spoaced a distance from the tops so that a layer of foam or other soft material may be placed therebetween so that the foam or soft material contacts the top of individual pieces (not shown). This minimizes movement, and of course breakage, of the individual pieces 24 during shipment.

Figure 3:
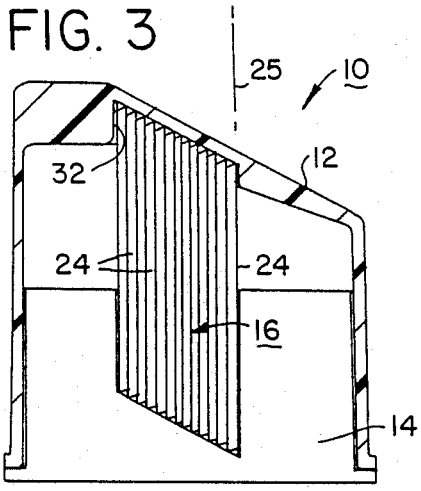
FIG. 3 is a cross sectional view showing a modified form of the present invention, the portion is not cross-hatched for clarity.

Referring to FIG. 3 the cover 12 is shown as having a recess 32 shaped so as to conform to the configuration of the top of the plurality pieces 24. This configuration assists in securely holding the pieces 24 in a secure manner.

While the present invention is particularly useful in handling a thin slide such as cover glass, the present invention can also be very beneficial when used with other glass slides which are difficult to handle without touching the surface thereof such as microscope slides. Generally microscope slides having a thickness no greater than about 1.5 mm.

Figure 4:
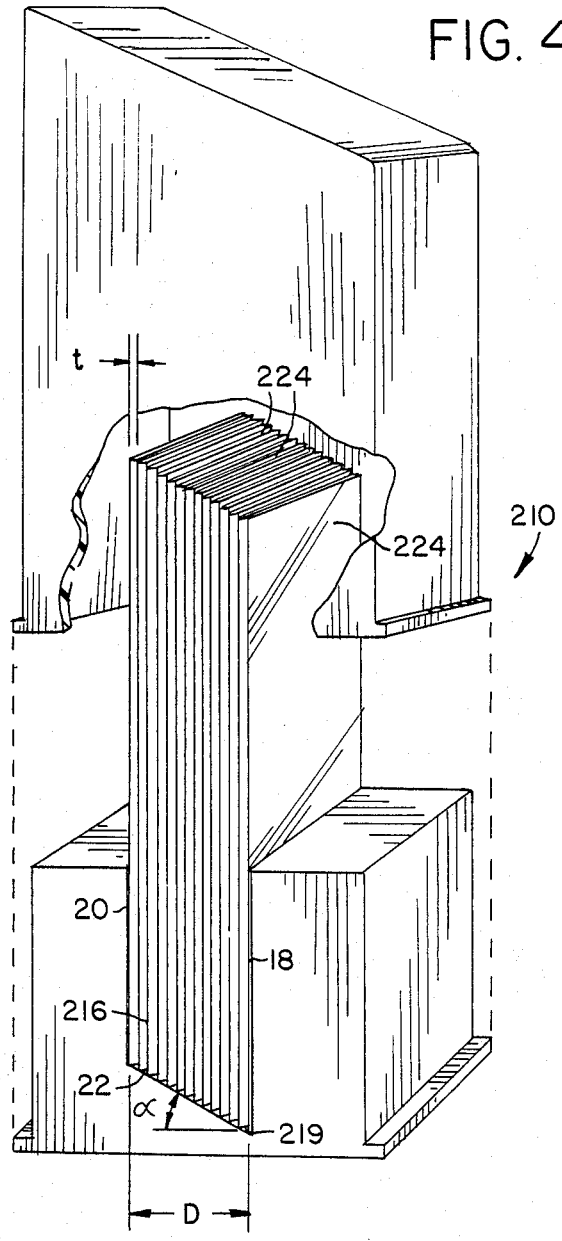
FIG. 4 is an exploded perspective view of the container made in accordance with the present invention for holding a plurality of microscope slides.

Referring to FIG. 4 there is illustrated a container 210 similar to container 10 of FIG. 1, like numerals referring to identical parts. The container 10 has a well 216 which is substantially identical to well 16 of FIG. 1 except for its shape and size. Well 216 is designed to hold a plurailty of microscope slides 224. The microscope slides 224 are preferably disposed in well 216 such that the short side 219 is placed on bottom surface 22. Typically, an individual microscope slide 224 has a thickness t in the range of 0.9 mm to 1.33 mm. In the particular embodiment illustrated each microscope slide 224 has a thickness t of about 1.0 mm. The slides 224 are placed on a short side 219 so that a sufficient number of microscope slides 224 can be placed in well 216 so that the slides will not fall into well 216 and lie flat on the bottom surface 22. In order to reinforce the stability of container 210, the container 210 may be provided with a plurality of narrow wells 216 placed in the same container adjacent each other and separated by an appropriate spacer (not shown). In this way the width of the container 210 will not be substantially less than length of the container 210 from front to back. However, if desired, the microscope slide may be in the well 216 so that the long side rest on bottom surface 22. This will restrict the number of slides that may be placed next to each other.

Various changes and modifications may be made to the invention without departing from the scope of the present invention. For example, in the preferred embodiment of the invention, the base portion 14 is illustrated as being made of a single mold part, however, the base portion may comprise of several individual pieces joined together. Additionally, the base portion itself may be put into a separate bottom cover. Further, various other configurations may be provided for cover 12 to assist in holding pieces 24 in position 1. Also more than one well may be provided in base portion.

What is claimed is:

1. A storage, shipping and dispensing container for a plurality of pieces of cover glass comprising:

a plurality of substantially identical size pieces of cover glass disposed adjacent each other within said container;

a base portion having at least one well for receiving said plurality of pieces of cover glass, said well having front wall, a back wall and a pair of side walls and having a single substantially planar bottom surface disposed at an acute angle with respect to a plane perpendicular to the vertical plane of said pieces of cover glass placed in said well so as to allow all of said adjacent pieces of cover glass to extend above adjacent pieces to facilitate removal thereof by the fingers of a user;

a top cover mating with said base portion whereby completely enclosing said pieces of cover glass.

2. A container according to claim 1 wherein said angle is in the range of 10° to 80°.

3. A container according to claim 1 wherein said angle is such that the difference in height between tops adjacent pieces of cover glass is approximately 0.1 mm.

4. A container according to claim 1 wherein said angle is such that the difference in height between tops adjacent pieces of cover glass is in the same order of magnitude as the thickness of cover glass.

5. A container according to claim 4 wherein the distance between said front wall and said back wall is no greater than about 95 per cent of the height of said individual piece of cover glass.

6. A container according to claim 1 wherein said well portion comprises a substantially vertical front wall portion extending from said bottom surface and a substantially vertical rear wall extending from said bottom surface spaced from said front wall.

7. A container according to claim 1 wherein the height of said front wall is in the range of 10 per cent to 80 cent of the height of said individual pieces of cover glass placed therein.

8. A container according to claim 1 further comprising a cover for placement over said base portion, said cover having means for holding in position said pieces when said cover is in the closed position on said base portion.

9. A container according to claim 1 wherein said means for holding in position said pieces comprises a recess for receiving the tops of said plurality of pieces of cover glass.

10. A container according to claim 1 further comprising a cover, said cover being shaped such that where said cover is placed in the closed position on said base portion the cover substantially contacts said plurality of pieces.

11. A shipping, storage and dispensing container for pluralities of thin glass plates comprising:

a plurality of substantiall identical sized thin glass plates disposed adjacent each other within said container;

the base portion having at least one well for receiving said pluarlity pieces of thin glass plates said well having a single substantially planar bottom surface, a substantially vertical extending front wall at one end of said bottom surface, a pair of side walls and a substantially vertical extending back wall extending from said bottom surface and spaced from said front wall, said bottom surface being disposed at an acute angle such that each individual piece of cover glass extends a height above the next adjacent piece of cover glass so as to be easily gripped by the fingers of a person for removal from said container;

a cover for placement over said base portion and completely enclosing said plurality of pieces of glass plates.

12. A container for a plurality of pieces of thin glass plates comprising:

a plurality of substantially identical size pieces of glass plates disposed adjacent each other in said container;

a base portion having at least one well for receiving front wall, a back wall and a pair of side walls and having a single substantially planar bottom surface disposed at an acute angle with respect to the vertical plane of said pieces of glass plates in said well so as to allow each of said adjacent pieces of said thin glass plates to extend above adjacent pieces to facilitate removal thereof by the fingers of a user;

a cover for mating with the engagements of base portion and enclosing said thin glass plates.

13. A container according to claim 12 wherein said angle is such that the difference in height between tops adjacent pieces of cover glass is approximately 0.1 mm.

14. A container according to claim 12 wherein said angle is such that the difference in height between tops adjacent pieces of cover glass is in the same order of magnitude as the thickness of cover glass.

15. A container according to claim 12 wherein said well portion comprises a substantially vertical front wall portion extending from said bottom surface and a substantially vertical rear wall extending from said bottom surface spaced from said front wall.

16. A container according to claim 12 wherein the height of said front wall is in the range of 10 per cent to 80 per cent of the height of said individual pieces of glass plates placed therein.

17. A storage, shipping and dispensing container of a plurality of pieces of microscope slides comprising:

a plurality of substantially identical sized pieces of microscope slides disposed adjacent each other within said container;

a base portion having at least one well for receiving said plurality of microscope slides, said well having a front wall, a back wall and a pair of side walls and having single substantialy planar bottom surface disposed at an acute angle with respect to plane perpendicular to the vertical plane of said pieces of microscope slides place in said well so as to allow each of said adjacent microscope slides to extend above adjcent slides to facilitate removal thereof by the fingers of a user;

a cover for mating with the base portion and enclosing said microscope slides.

18. A container according to claim 17 wherein said angle is such that the difference in height between tops adjacent pieces of microscope slides is approximately 0.1 mm.

19. A container according to claim 17 wherein said angle is such that the difference in height between tops adjacent pieces of microscope slides is in the same order of magnitude as the thickness of cover glass.

20. A container according to claim 17 wherein said well portion comprises a substantially vertical front wall portion extending from said bottom surface and a substantially vertical rear wall extending from said bottom surface spaced from said front wall.

21. A container according to claim 17 wherein the distance between said front wall and said back wall is no greater than about 95 per cent of the height of one of said microscope slides.

* * * * *